United States Patent [19]

Griffin et al.

[11] 4,249,848

[45] Feb. 10, 1981

[54] TRANSPORTABLE, COLLAPSIBLE VEHICLE LOADING HOPPER

[76] Inventors: Cecil A. Griffin, 5911 S. 129th, Seattle, Wash. 98178; Gerald J. Des Jarlais, 16712 NE. 31st, Bellevue, Wash. 98008

[21] Appl. No.: 82,118

[22] Filed: Oct. 5, 1979

Related U.S. Application Data

[63] Continuation of Ser. No. 873,107, Jan. 30, 1978, abandoned.

[51] Int. Cl.[3] ..... B65G 1/00

[52] U.S. Cl. ..... 414/332; 414/595

[58] Field of Search ..... 222/547, 558, 564; 366/26, 27, 30, 33, 36, 40; 414/332, 787, 595

[56] References Cited

U.S. PATENT DOCUMENTS

| | | | |
|---|---|---|---|
| 894,085 | 7/1908 | Tolson | 414/595 |
| 3,322,289 | 5/1967 | Wendell et al. | 414/595 |
| 3,414,173 | 12/1968 | Sackett, Sr. | 222/564 |
| 3,586,181 | 6/1971 | Brock | 414/332 |
| 3,905,587 | 9/1975 | Preeman | 336/25 |
| 3,934,739 | 1/1976 | Zumsteg et al. | 414/332 |
| 4,026,441 | 5/1977 | Jones | 414/332 |
| 4,111,314 | 9/1978 | Nelson | 414/787 |

*Primary Examiner*—Lawrence J. Oresky

*Attorney, Agent, or Firm*—Seed, Berry, Vernon & Baynham

[57] ABSTRACT

A loading bin is carried on a wheel-supported transportable frame in a collapsed condition in which the upper filling end of the loading bin is below vertical height road clearances for highways. The bin can be elevated at the construction site so that its discharge end is above the height of the vehicles being loaded. The bin is filled by a cart traveling along a track from ground to an elevation above the bin with the track being deployed automatically upon raising of the bin. The cart automatically dumps its load into the bin upon reaching the filling end of the bin.

8 Claims, 11 Drawing Figures

FIG. 8
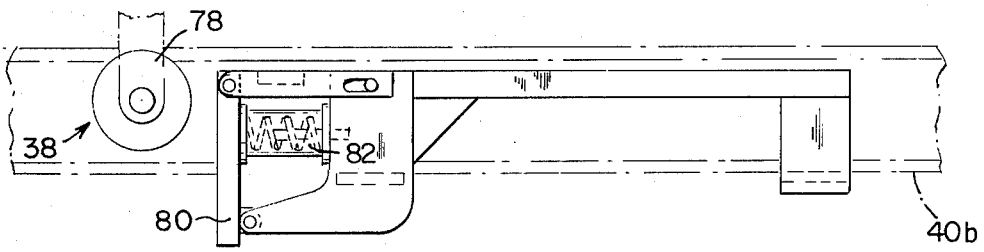
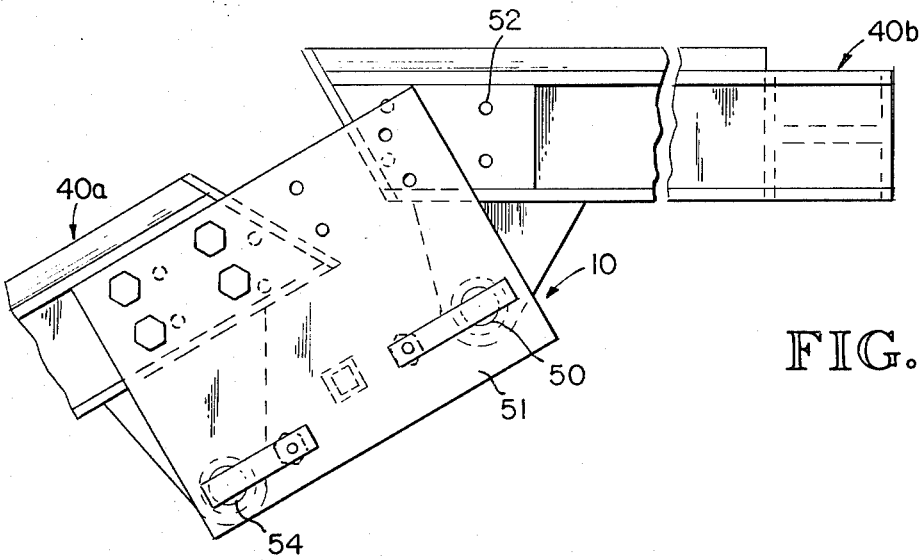
FIG. 9
FIG. 10
FIG. 11
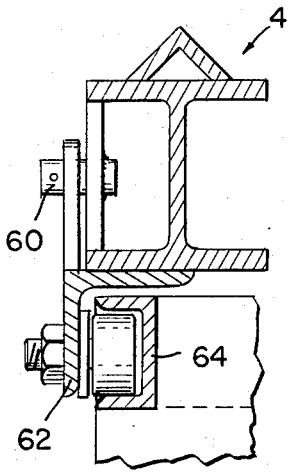
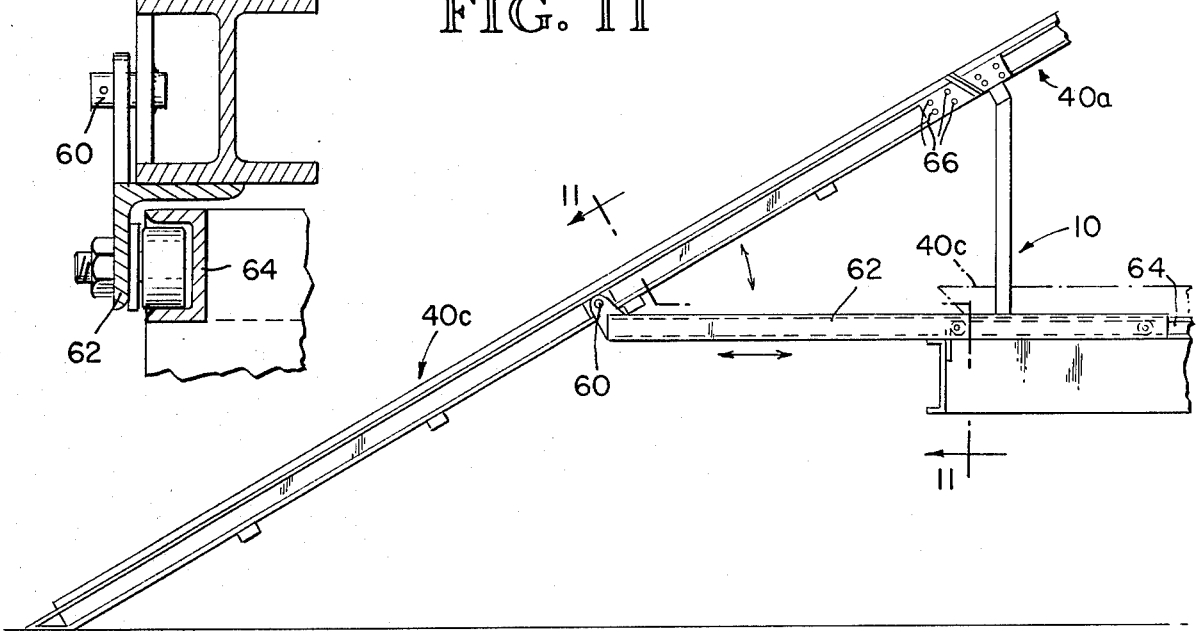

TRANSPORTABLE, COLLAPSIBLE VEHICLE LOADING HOPPER

This is a continuation, of application Ser. No. 873,107, filed Jan. 30, 1978 now abandoned.

BACKGROUND OF THE INVENTION

1. Field of the Invention

This invention pertains to portable truck loading apparatus, and more particularly to transportable, collapsible loading hoppers adapted for loading asphalt or other product at the construction site rather than at a remote fixed manufacturing facility.

2. Description of the Prior Art

Mobile asphalt plants such as described in U.S. Pat. No. 3,905,587 are known. In the patented device the asphalt plant as well as a truck loading hopper are trailed to the construction site and erected such that vehicles can drive beneath the hopper and be filled with the asphalt which is manufactured right at the site. These portable plants and truck loading hoppers offer considerable economies over conventional practice of manufacturing the asphalt at a remote central location and trucking the hot asphalt to the construction site.

One of the difficulties, however, with prior portable truck loading hoppers, in particular, is that they have required considerable manpower and time to erect and dismantle at the construction site. For example, U.S. Pat. No. 3,905,587 discloses the use of a bucket conveyor for lifting the asphalt from the mixing plant and depositing it in the inlet end of the hopper. This conveyor requires considerable effor to be dismantled and carried during transporting of the hopper to and from the construction site. In addition, the asphalt being by nature sticky and corrosive causes considerable maintenance difficulties in continued operation of the bucket conveyor.

SUMMARY OF THE INVENTION

It is an object of this invention to provide an improved transportable, collapsible vehicle loading hopper for filling vehicles with sticky, corrosive material such as asphalt.

It is another object of this invention to provide an easily and quickly erected transportable vehicle loading hopper.

Basically, these objects are obtained by providing a transportable frame carried on ground supporting wheels and mounting on the frame a vertically extendible loading bin having an upper or filling end that can be carried below vertical road clearances on the highways and a lower discharge end which can be elevated higher than the vehicles requiring loading. The bin is uniquely kept filled by a cart which rides on an elongated track extending from the ground level to an elevation above the inlet end of the bin. The track is pivotally mounted to the transportable frame and is erected to its deployed position automatically by the raising of the bin. Additional segments of the track necessary to extend it to ground level are easily and quickly assembled. The bin is elevated and the cart reciprocated by self-contained mechanisms carried on the transportable frame.

As is readily apparent, the transportable, collapsible vehicle loading hopper can be carried long distances to a construction site and once located can be quickly put into full operation. The use of a cart carried on an elevated track for loading the bin provides the advantage of quick and easy collapsibility of the conveying system as well as ease of maintenance and increased filling capacity over prior art bucket conveyors.

BRIEF DESCRIPTION OF THE FIGURES OF THE DRAWING

FIG. 8 is a fragmentary side elevation of a portion of the track overlying the bin inlet N and illustrating the automatic dumping aspect of the cart.

FIG. 9 is a fragmentary detail showing a pivotal coupling of the track employed in the hopper of FIG. 1.

FIG. 10 is a fragmentary side elevation of a portion of the track employed in the hopper of FIG. 1.

FIG. 11 is a section taken along the line 11—11 of FIG. 10 illustrating an extendible position of the lower end of the track.

DETAILED DESCRIPTION OF THE PREFERRED EMBODIMENTS

Figure 1:
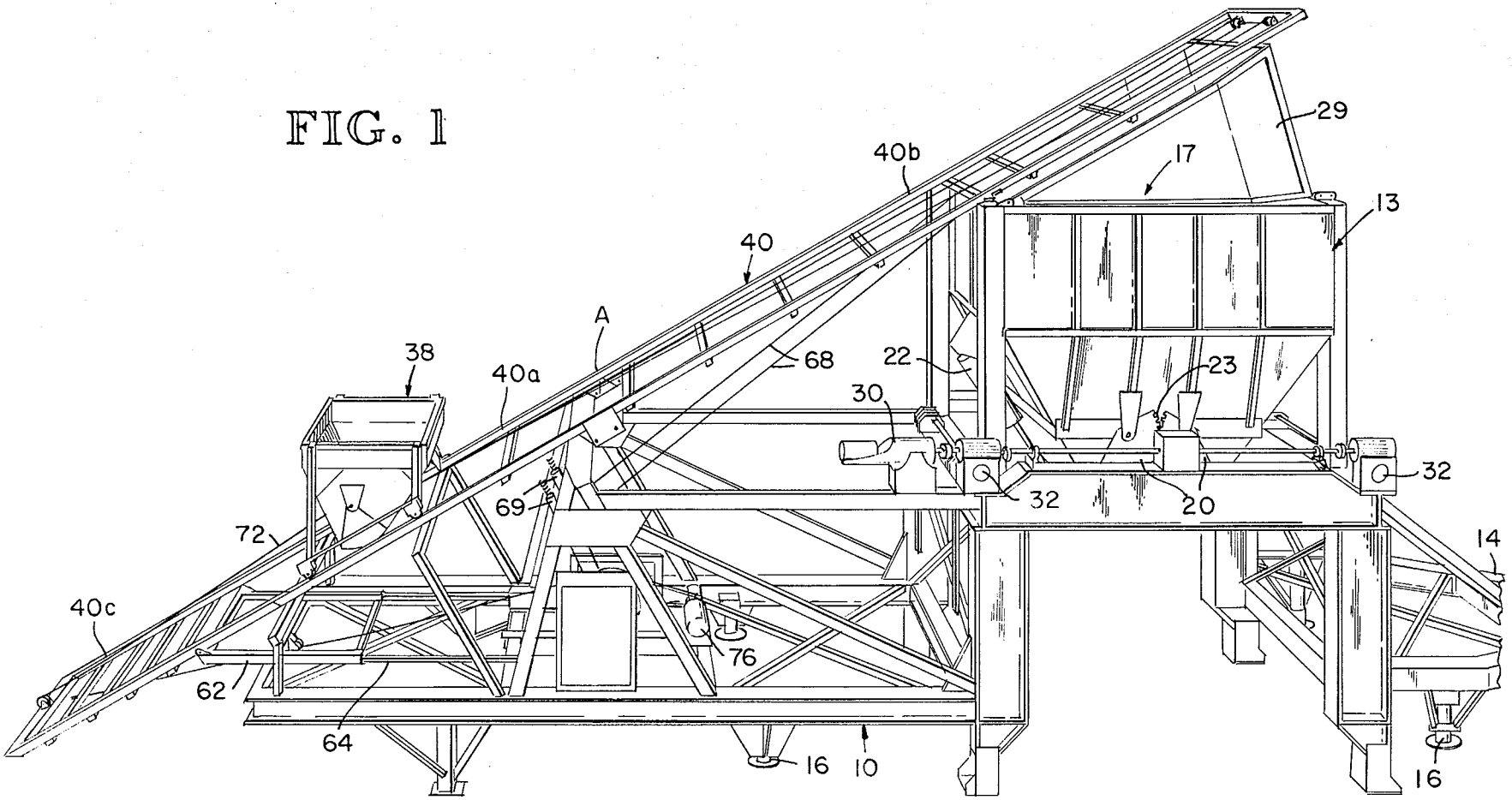
FIG. 1 is a perspective of a transportable, collapsible vehicle loading hopper embodying the principles of the invention.
Figure 3:
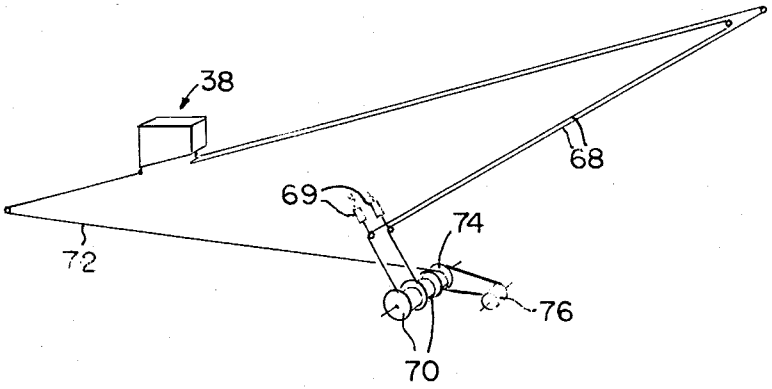
FIG. 3 is a fragmentary schematic showing the means for reciprocating the cart used in the hopper of FIG. 1.

As best shown in FIG. 1 the transportable, collapsible vehicle loading hopper employs a transportable frame 10 carried by ground engaging wheels 12 and a forward end 14 adapted to be carried by a tractor or other vehicle 15. The frame is provided with telescopic supports or posts 16 which at the construction site are lowered to support the frame after the frame is jacked-up sufficient to remove the load from the wheels. Thus at the construction site the transportable frame is held in a stable stationary position by the posts 16.

Figure 2:
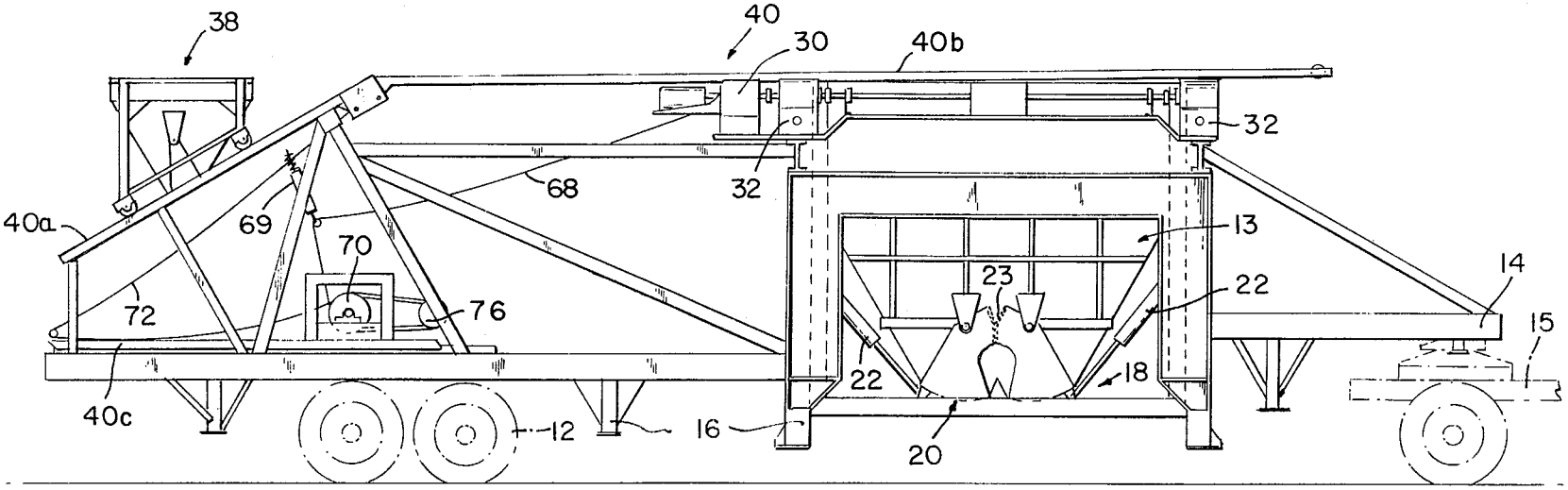
FIG. 2 is a side elevation of the hopper shown in FIG. 1.
Figure 5:
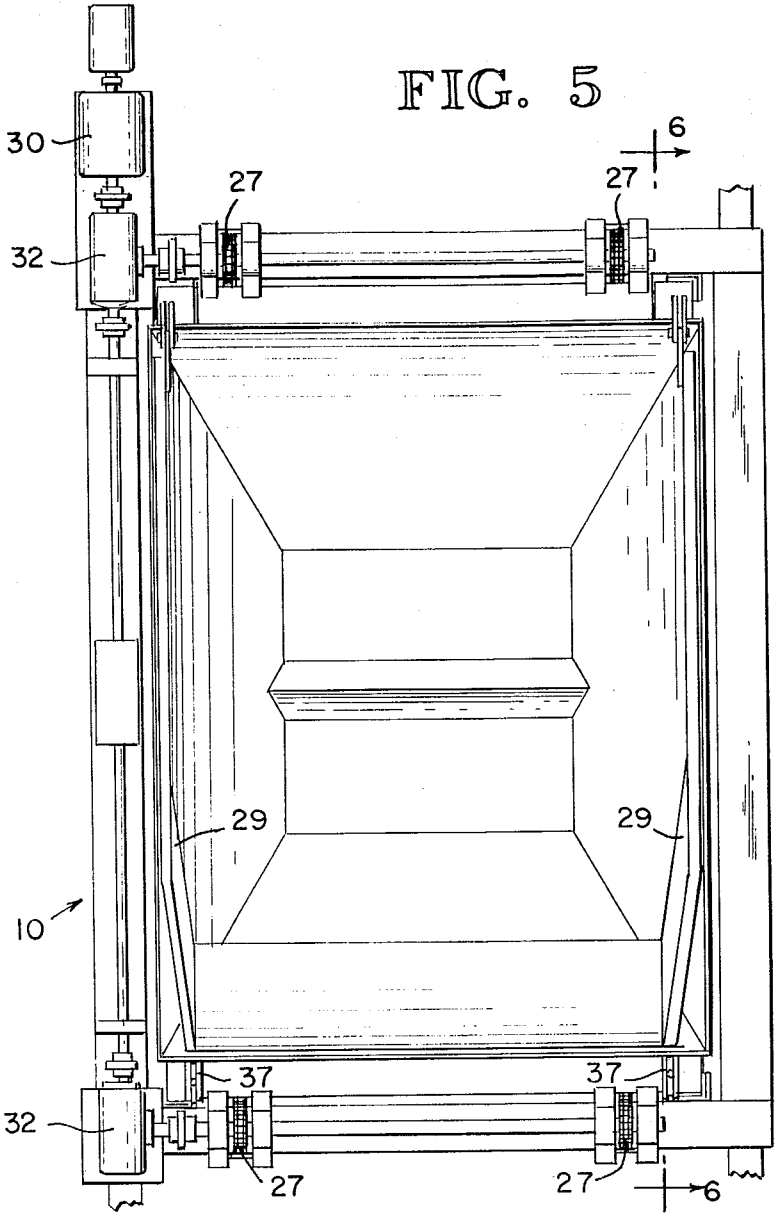
FIG. 5 is a fragmentary plan of the bin shown in FIG. 4.

The hopper includes a vehicle loading bin 13 having a filling end 17 and a discharge end 18 (FIG. 2). The discharge end has two large discharge openings as shown in FIGS. 2 and 5 each of which is closed by a clam shell gate 20 which are opened by pneumatic or hydraulic actuators 22. The gates operate in synchronism through meshing gears 23.

Figure 4:
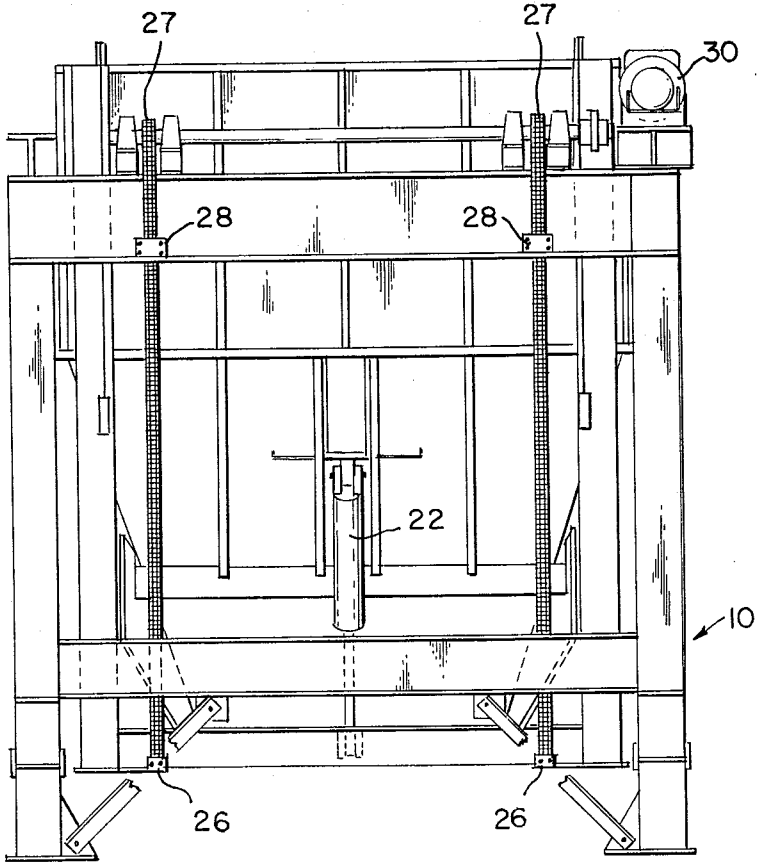
FIG. 4 is a fragmentary end elevation of the vehicle loading bin employed in the hopper of FIG. 1.

The bin is raised and lowered by sets of chains on either end of the bin which are dead ended to the bottom of the bin as at 26 (FIG. 4) and pass over sprockets 27 which are rotatably mounted on the frame 10 with the opposite ends of the chains being dead ended on the frame member 10 as at 28. Each of the sets of chains is powered by a motor 30 which drives gear reduction units 32 to rotate both sets of sprockets 27. Rotation of the sprockets causes the chain to be raised thus lifting the bin from below until it reaches the elevated position shown in FIG. 1. Lowering of the bin occurs by the reverse rotation of the sprockets 27 until the bin is in the lowered position in FIG. 2.

Figure 6:
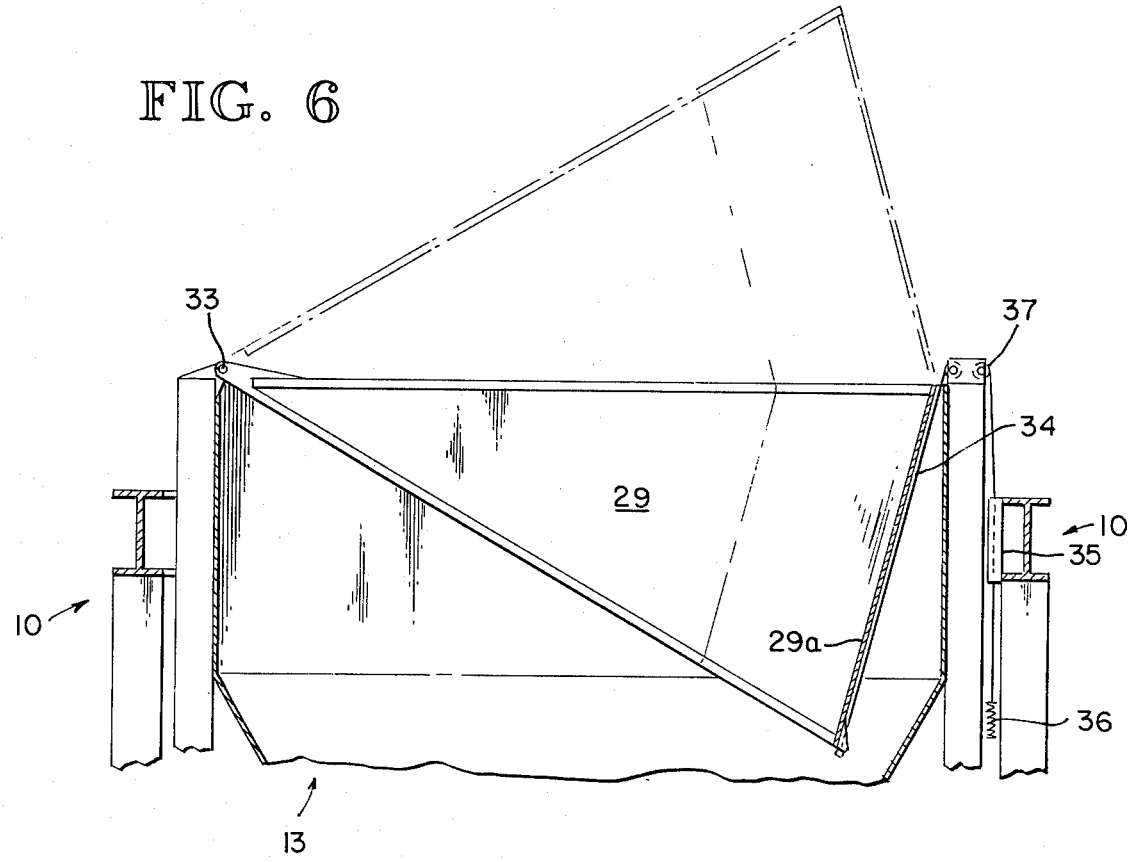
FIG. 6 is a fragmentary vertical section of the bin shown in FIG. 5.

As best shown in FIG. 6 the inlet or filling end 17 of the bin 13 is provided with opposite pivotal side plates 29 each pivotally mounted to the bin as at 33 with the free end suspended into the bin in the collapsed position as shown in solid lines in FIG. 6 by cables 34. The cables run over sheaves 37 at the top of the bin and through sleeves 35 fixed to the frame 10. The end of each cable is provided with a spring 36. As the bin is elevated the spring ends of the cables are raised by the cable until each spring engages the sleeve 35. Further upward movement of the bin then draws the cable 34 at the free end of the side panels 32 upwardly relative to the bin so that as the bin reaches the fully extended position in FIG. 1 the side panels are in the raised position illustrated in phantom in FIG. 6. The side panels prevent spillage from the cart when loading through the inlet end of the bin.

The hopper is provided with a filling cart 38 which travels on an elongated track 40. The track has a semi-stationary portion 40*a*, a pivotal upper section 40*b* and a removable lower section 40*c*. As best shown in FIG. 2 the pivotal section is lowered by the bin into the position where the combined vertical height of the wheel-carried frame and cart does not exceed the vertical height clearance allowed on highways. However, in the elevated position the track is in a straight line between ground; overlying the inlet end of the bin and supported by the elevated plate 29A as shown in FIG. 1.

The track 40 has its stationary section 40*a* permanently fixed to the frame 10. As best shown in FIG. 9 the upper section of the track 40*b* is pivotally connected at its lower end on a pivot post 50 fastened to a bracket 51 that is secured to frame 10. The section 40*b* is lifted by the bin into the inclined position in abutment with the stationary section 40*a*. Once in place bolts are placed through holes 52 to secure the upper section 40*b*. The nominal height of the raised bin is 14 feet. If it is desirable or necessary to extend the bin further, for example, to 14 feet 6 inches, the inclination of the track must be increased which requires also, therefore, changing the location of the upper end of the track 40*a*. The track is also pivotally mounted by a post 54 to the bracket 51 and is provided with additional bolt holes for this purpose.

The lower section 40*c* is best illustrated in FIGS. 10 and 11. This section is uniquely pivotally carried by a slidable pivot 60 that is secured to the outer end of a carriage 62. The carriage 62 rides in a track 64 so that it can be extended either into the position shown in FIG. 10 or by disconnecting bolts 66 the track can be swung clockwise about the pivot 60 to a horizontal position and then pushed to the right as shown in phantom lines in FIG. 10 into a stored position. The stored position is also shown in FIG. 2. In this manner a single operator can quickly roll the lower section 40*c* outwardly, swing it into position and bolt it to the stationary track 40*a*.

Figure 7:
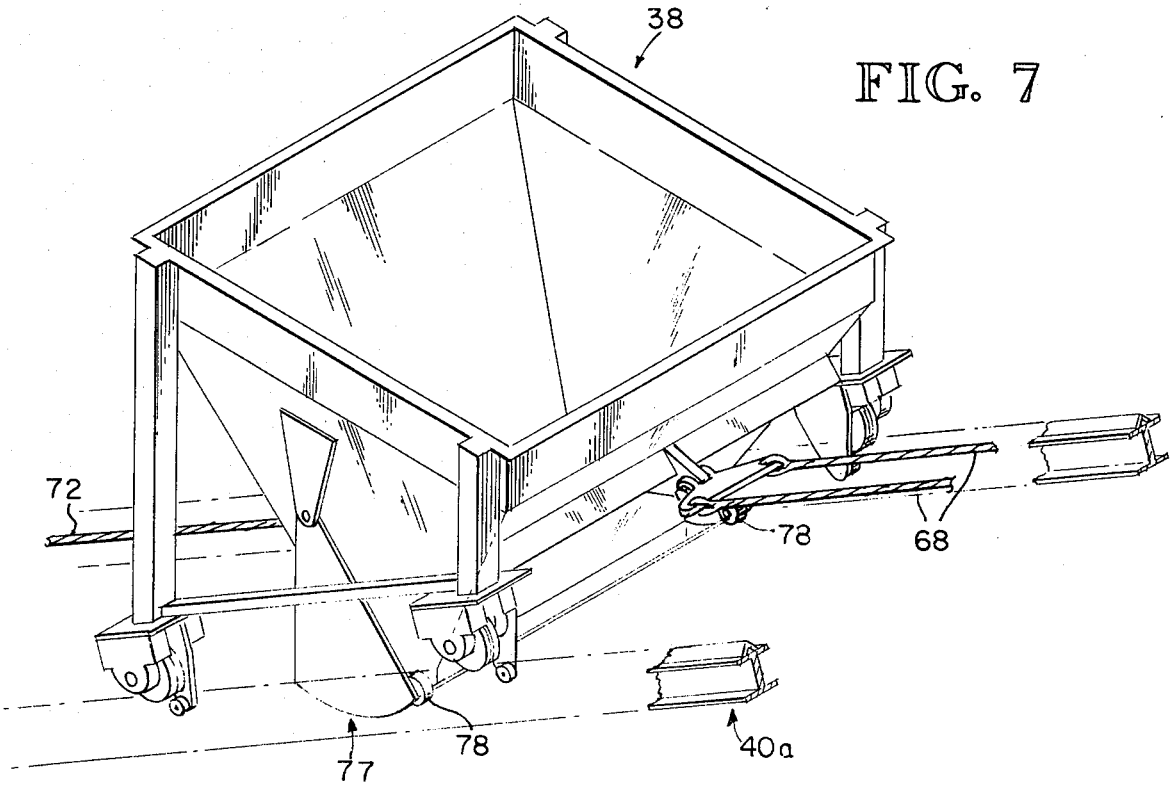
FIG. 7 is an isometric of the bin filling cart shown in FIG. 1.

The cart is moved along the track by a pair of elevating cables 68 which travel about spring loaded sheaves 69 that are attached to the frame 10 and thence about drums 70. Similarly, the cart is pulled back down the track by a single cable 72 that is wrapped around a drum 74. A motor 76 powers the drum so that the cables are let out and returned simultaneously. The cart is provided with an automatic dump gate 77 that is provided with actuating rollers 78 along its forward edge (FIGS. 7 and 8). Positioned on the track overlying the inlet end of the bin 13 is a stop mechanism 80. The stop mechanism 80 is provided with a shock absorbing spring 82 and a conventional switch actuator 83. The switch actuator such as a reed switch, photo-cell or other conventional switch for signaling the presence of the cart is set to stop the motor 76 a predetermined distance after the rollers 78 engage the stop mechanism 80. Thus the cart continues a short distance further but the rollers 78 are stopped causing the gate 77 to swing clockwise into an open position automatically dumping the contents of the cart into the bin. When the cart is emptied it automatically reverses to be refilled.

In operation, the transportable, collapsible hopper is trailed to the construction site and the frame raised on its telescopic posts 16. The bin is then raised and the track bolted in place. The asphalt plant then discharges asphalt into the cart which can make several trips up and down the track to maintain the bin filled while trucks pass beneath the bin and are filled. When the operation is completed the track is unbolted and the sections returned to their storage position as the bin is lowered. The hopper is then transported to its new location to begin operation again.

While the preferred embodiments of the invention have been illustrated and described it should be understood that variations will be apparent to one skilled in the art without departing from the principles herein. Accordingly, the invention is not to be limited to the specific embodiment shown in the drawings.

I claim:

1. A transportable, collapsible vehicle loading hopper for filling trucks or the like with stickly substances like asphaltic mix or other sticky mixed product from a mixing device at a remote construction site, comprising:

a transportable frame supported on ground engaging wheels, a vertically raisable one piece holding bin having a truncated lower portion terminating in a large discharge end adapted to be above a vehicle when the bin is in a raised position and below the vertical height clearance normally encountered on highways when in a lowered transporting position and an upper filling end adapted to be below the vertical height clearance normally encountered on highways when in said lowered transporting position, said rectangular bin lower truncated rectangular discharge end including at least two separate generally rectangular discharge openings, and a gate closing each said opening thereby increasing the flow area out of the bin without increasing vertical height of the discharge end, said combined discharge openings having a large area;

means for linearly vertically moving said bin within said frame so that the vertical axis of said bin remains parallel with the vertical axis of said frame, said bin being telescoped in a unitary unmodified condition between said raised position and said lowered transporting position such that the height of said frame and bin is reduced in said transporting position without increasing the length or width of said frame and bin, mix delivery means extending from ground to above said bin when the bin is raised, and including means for transporting the mix from the mixing device to the upper filling end of the bin, and means for collapsing the delivery means into a position supported solely on said frame but below said vertical height clearance.

2. The vehicle loading hopper of claim 1, including means supporting the mix delivery means on the bin for simultaneously raising said mix delivery means with the bin.

3. The vehicle loading hopper of claim 2, said mix delivery means including a track said means for transporting the mix being a cart movable on the track and having a dump end, and cart moving means including cable means for pulling the cart along the track and means for powering said cable means.

4. The vehicle loading hopper of claim 3, including a stop on said track overlying the bin filling end, a gate for closing the dump end of the cart, and means on said gate engagable with said stop for opening the gate by movement of the cart past the stop.

5. The vehicle loading hopper of claim 1, including opposite side plates extendibly mounted to the bin and an end plate joined to said side plates, means for raising said side and end plates into a raised portion when the bin is raised for providing a confined mix area above the bin upper filling end.

6. The vehicle loading hopper of claim 5, said end plate supporting said mix delivery means directly above said bin filling end when said plates are in said raised position.

7. A transportable, collapsible vehicle loading hopper for filling trucks or the like with sticky substances like asphaltic mix or other sticky mixed product from a mixing device at a remote construction site, comprising:

a transportable frame supported on ground engaging wheels, a vertically raisable one piece rectangular holding bin having a truncated rectangular lower discharge end adapted to be above a vehicle when the bin is raised and below the vertical height clearance normally encountered on highways when in a transporting position and an upper filling end adapted to be below the vertical height clearance normally encountered on highways when in a transporting position, means for raising and lowering said bin in a unitary unmodified condition, mix delivery means extending from ground to above said bin when the bin is raised, and including means for transporting the mix from the mixing device to the upper filling end of the bin, and means for collapsing the delivery means into a position supported solely on said frame but below said vertical height clearance, said mix delivery means including a track having a pivotable and slidable ground engaging end, stationary central portion and a pivotable upper end supported on said bin wherein raising of said bin automatically deploys said track upper end into an operative extended position.

8. A transportable, collapsible vehicle loading hopper for filling trucks or the like with sticky substances like asphaltic mix or other sticky mixed product from a mixing device at a remote construction site, comprising:

a transportable frame supported on ground engaging wheels, a vertically raisable one piece rectangular holding bin having a truncated rectangular lower discharge end adapted to be above a vehicle when the bin is raised and below the vertical height clearance normally encountered on highways when in a transporting position and an upper filling end adapted to be below the vertical height clearance normally encountered on highways when in a transporting position, means for raising and lowering said bin in a unitary unmodified condition, mix delivery means extending from ground to above said bin when the bin is raised, and including means for transporting the mix from the mixing device to the upper filling end of the bin, and means for collapsing the delivery means into a position supported solely on said frame but below said vertical height clearance, said means for raising and lowering said bin including a set of chains dead ended at said lower discharge end of the bin and coupled to powered sprockets rotatably fastened to said frame at an elevated position whereby rotation of the sprockets will raise said bin into its extended position, and side shield members pivotally coupled to the bin and to cables engageable with said frame as the bin is raised whereby the cables pull the shield members into shielding raised positions above the upper filling end of the bin solely by raising the bin.

* * * * *